US012264383B2

(12) United States Patent
Detrois et al.

(10) Patent No.: US 12,264,383 B2
(45) Date of Patent: Apr. 1, 2025

(54) NiCrMoNb AGE HARDENABLE ALLOY FOR CREEP-RESISTANT HIGH TEMPERATURE APPLICATIONS, AND METHODS OF MAKING

(71) Applicant: Battelle Memorial Institute, Columbus, OH (US)

(72) Inventors: Martin Detrois, Salem, OR (US); Paul D. Jablonski, Salem, OR (US); Jeffrey A. Hawk, Salem, OR (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 18/490,286

(22) Filed: Oct. 19, 2023

(65) Prior Publication Data

US 2024/0043967 A1 Feb. 8, 2024

Related U.S. Application Data

(62) Division of application No. 17/511,594, filed on Oct. 27, 2021, now Pat. No. 11,827,955.

(60) Provisional application No. 63/125,888, filed on Dec. 15, 2020.

(51) Int. Cl.
*C22F 1/10* (2006.01)
*C22C 19/05* (2006.01)

(52) U.S. Cl.
CPC ..... *C22C 19/055* (2013.01); *C22F 1/10* (2013.01)

(58) Field of Classification Search
CPC ..... C22F 1/10; C22C 19/055; C22C 19/056
See application file for complete search history.

(56) References Cited

U.S. PATENT DOCUMENTS 2,914,841 A * 12/1959 Graham ..... B23P 15/02 416/232
5,556,594 A 9/1996 Frank et al.
6,132,535 A * 10/2000 Okada ..... C22C 19/055 420/451
6,315,846 B1 11/2001 Hibner et al.
7,156,932 B2 1/2007 Cao et al.
8,313,593 B2 11/2012 Hawk et al.
10,787,723 B2 9/2020 Lukezic

FOREIGN PATENT DOCUMENTS

WO 2000003053 A1 1/2000
WO WO-2008091377 A2 * 7/2008 ..... C22C 19/03

OTHER PUBLICATIONS

Li, Hongyu, et al. "Characterization of γ' precipitates in a nickel base superalloy quenching from aging temperature at different rates." Rare Metals 29 (2010): 204-208.*
Detrois, M. et al., "Compositional Design and Mechanical Properties of INCONEL Alloy 725", Proceedings of the 9th International Symposium on Superalloy 718 & Derivatives: Energy, Aerospace, and Industrial Applications, Springer International Publishing, Pittsburgh, PA, 2018: pp. 421-437.
Frank, R. B., Custom Age 625 Plus Alloy—A Higher Strength Alternative to Alloy 725, in: A. Loria, Proceedings of the Superalloys 718, 625, and Various Derivatives, 1991: pp. 879-893 https://www.worldcat.org/title/superalloys-718-625-and-various-derivatives/oclc/24056120.
Jablonski and Hawk, J. Mat. Eng. and Perf. vol. 26, No. 1, 4-13 (2017), "Homogenizing Advanced Alloys: Thermodynamic andKinetic Simulations Followed by Experimental Results". doi.org/10.1007/s11665-016-2451-3.
International Search Report from International Application No. PCT/US2021/063557 date of mailing Jun. 1, 2022.
Written Opinion of the International Search Authority from International Application No. PCT/US2021/063557 date of mailing Jun. 1, 2022.
International Preliminary Examination Report on Patentability from International Application No. PCT/US2021/063557 dated Jun. 13, 2023.

* cited by examiner

*Primary Examiner* — Jessee R Roe
(74) *Attorney, Agent, or Firm* — Susanne A. Wilson; Frank Rosenberg

(57) ABSTRACT

Nickel alloys, methods of making nickel alloys, articles including the nickel alloys, uses of the alloys, and methods of treating nickel alloys are described. The inventive heat resistant structural materials are suitable for applications requiring high yield stress at room temperature and good creep strength at high temperatures, such as in gas turbines, steam turbines, fossil energy boilers, aero engines, power generation systems using fluids such as supercritical carbon dioxide (e.g., advanced ultra-supercritical power plants), concentrated solar power plants, nuclear power plants, molten salt reactors: turbine blades, casings, valves, heat exchangers and recuperators.

18 Claims, 7 Drawing Sheets

NiCrMoNb AGE HARDENABLE ALLOY FOR CREEP-RESISTANT HIGH TEMPERATURE APPLICATIONS, AND METHODS OF MAKING

RELATED APPLICATIONS

This application claims the priority benefit of U.S. Provisional Patent Application Ser. No. 63/125,888 filed 15 Dec. 2020.

GOVERNMENT RIGHTS CLAUSE

This invention was made with Government support under contract 89243318CFE000003 awarded by the U.S. Department of Energy. The Government has certain rights in this invention.

INTRODUCTION

Future power plant designs, such as advanced ultra-supercritical (A-USC) and/or supercritical $CO_2$ ($sCO_2$) power plants are expected to raise the efficiencies of coal-fired power plants from about 35% to >50% and decrease harmful gas emissions. In order to achieve this goal, the operating temperatures of high-yield stress components in the coal-fired boiler and steam turbine must be increased to at least 700° C., and up to 750° C., if possible. Under those conditions, traditional ferritic-martensitic high-strength steels and austenitic stainless steels will need to be replaced by Ni-based superalloys to meet the high-temperature tensile and creep strength requirements. Alternatively, next generation gas turbines need alloys for rotors that possess high-yield stress and environmental resistance to crack formation and growth (i.e., for cycling operation) at temperatures up to 750° C. to minimize efficiency losses due to steam cooling to achieve the desired 70% efficiency target.

The NiCrMoNb alloy (INCONEL 725, Table 1A, or Custom Age 625 PLUS, Table 1B) possesses great resistance to elevated temperature corrosion (<260° C.) as well as having very good yield stress and tensile strength at the temperatures of interest (typically <315° C.). The typical microstructure of these alloys consists of a face-centered cubic (FCC) matrix with γ'/γ" precipitates embedded within the γ matrix grains when heat treated appropriately. The γ' precipitates are $Ni_3$(Al, Ti) with ordered FCC $L1_2$ crystal structure while the γ" precipitates are typically $Ni_3$(Nb, Al, Ti) with an ordered tetragonal $D0_{22}$ crystal structure.

TABLE 1A

Composition range for INCONEL 725 (wt. %).
(https://www.specialmetals.com/assets/smc/documents/alloys/inconel/inconel-alloy-725.pdf)

| Element | Cr | Al | Ti | Nb | Fe* | C | Mn | Mo | Si | P | S | Ni |
|---|---|---|---|---|---|---|---|---|---|---|---|---|
| Minimum | 19.0 | — | 1.0 | 2.75 | Bal. | — | — | 7.0 | — | — | — | 55.0 |
| Maximum | 22.5 | 0.35 | 1.7 | 4.0 | Bal. | 0.03 | 0.35 | 9.5 | 0.20 | 0.015 | 0.010 | 59.0 |

*Reference to the 'balance' of a composition does not guarantee this is exclusively of the element mentioned but that it predominates and others are present only in minimal quantities.

TABLE 1B

Composition range for Custom Age 625 PLUS (wt. %).
(https://www.carpentertechnology.com/en/product-solutions/cartech-custom-age-625-plus-stainless/)

| Element | Cr | Al | Ti | Nb | Fe* | C | Mn | Mo | Si | P | S | Ni |
|---|---|---|---|---|---|---|---|---|---|---|---|---|
| Minimum | 19.0 | — | 1.0 | 2.75 | Bal | — | — | 7.0 | — | — | — | 59.0 |
| Maximum | 22.0 | 0.35 | 1.6 | 4.0 | Bal. | 0.03 | 0.20 | 9.5 | 0.20 | 0.015 | 0.010 | 63.0 |

*Reference to the 'balance' of a composition does not guarantee this is exclusively of the element mentioned but that it predominates and others are present only in minimal quantities.

Due to these alloys' high yield stress, good tensile strength and attractive high temperature oxidation/corrosion properties, INCONEL alloy 725 and Custom Age 625 PLUS find use in marine applications where resistance to pitting corrosion or stress corrosion cracking is essential. They have been used for the manufacture of various components such as hangers, landing nipples, mandrels, casings as well as fasteners. Custom Age 625 PLUS, in particular, has been used for components in deep sour gas wells, in refinery and chemical processing applications and as fasteners and shafts in marine environments where corrosion and stress corrosion are concerns. While use in these environments can go above room temperature, the use temperature for typical applications falls in the range of about 150 C to 260° C. While used at elevated temperatures, these alloys, however, were never intended for extended use at power plant operating temperatures typical of nickel superalloys.

Inconel 725 with variations in the standard aging heat treatment to increase room temperature yield are discussed in U.S. Pat. No. 6,315,846 and WO2000003053. Additional descriptions of Alloy 725 are discussed in M. Detrois, K. A. Rozman, P. D. Jablonski, J. A. Hawk, Compositional Design and Mechanical Properties of INCONEL® Alloy 725 Variants, in: E. Ott, X. Liu, J. Andersson, Z. Bi, K. Bockenstedt, I. Dempster, J. Groh, K. Heck, P. D. Jablonski, M. Kaplan, D. Nagahama, C. Sudbrack (Eds.), Proc. 9th Int. Symp. Superalloy 718 Deriv. Energy, Aerospace, Ind. Appl., Springer International Publishing, Pittsburgh, PA, 2018: pp. 421-437. https://doi.org/10.1007/978-3-319-89480-5_26

Alloy 625 is described in U.S. Pat. No. 5,556,594 and R. B. Frank, Custom Age 625 Plus Alloy—A Higher Strength Alternative to Alloy 725, in: A. Loria, Proceedings of the Superalloys 718, 625, and Various Derivatives, 1991: pp. 879-893. Grain boundary stitching using 6 phase precipitates in alloy 718 are discussed in U.S. Pat. No. 7,156,932.

In the last four years, NETL (National Energy Technology Laboratory) made variants of the base constituents of these alloys and tested their mechanical properties at 700° C. in creep and 750° C. in tension. While the results showed promising properties at the higher temperatures, chemistry modifications alone limited the development of the new alloy as a high-temperature, heat-resistant alloy.

SUMMARY OF THE INVENTION

In one aspect the invention provides a nickel alloy, comprising: 19.0 to 22.5% Cr; 0.1 to 1.0% Al; 1.0 to 2.0% Ti; 3.0 to 5.0% Nb; 0.1 to 4.0% Ta; 4.0 to 7.0% Nb+Ta; 2.0 to 4.0% Fe; 0 to 0.06% C; 0 to 0.35% Mn; 7.0 to 9.5% Mo; 0 to 5.0% W; 0 to 0.20% Si; 0 to 0.05% V; 0 to 0.15% P; 0 to 0.010% S; and 0 to 0.010% B.

Alloys of the invention can be further characterized by one or any combination of the following: wherein the balance of the alloy comprises Ni and no more than 1% of all other elements; comprising at least 0.1% Ta, or at least 0.2% Ta, or at least 1.0% Ta, or 0.1 to 4.0% Ta; or none or consisting essentially of none of Co; comprising at least 3.5% Nb, or at least 4.0% Nb; comprising a Ti/Al ratio between 1 and 20; comprising δ (and/or η) phase precipitates at the grain boundaries; comprising γ' (or γ" or γ'/γ") precipitates distributed within a γ matrix grain interior; characterizable by a time to failure at 700° C. and 483 MPa of at least 230 h, or at least 270 h, or at least 300 h, or at least 400 h, or in the range of 230 to 750 h or in the range of 230 to 700 h (the "time to failure" properties refer to measurements in creep using the ASTM standard E-139); characterizable by a time to failure at 790° C. and 207 MPa of at least 320 h, or at least 400 h, or at least 500 h, or in the range of 230 to 650 h or in the range of 230 to 550 h;

characterizable by a time to failure at 750° C. and 345 MPa of at least 180 h, or at least 200 h, or at least 250 h, or at least 300 h, or in the range of 180 to 500 h or in the range of 180 to 450 h; characterizable by ultimate tensile strength at room temperature of at least 1150 MPa, or at least 1250 MPa, or at least 1350 MPa, or in the range of 1150 to 1500 MPa (the properties refer to measurements in tension using the ASTM standard E-8); characterizable by ultimate tensile strength at 600° C. of at least 1050 MPa, or at least 1150 MPa, or at least 1250 MPa, or in the range of 1050 to 1400 MPa or 1050 to 1350 MPa (these properties refer to measurements in tension using the ASTM standard E-8); characterizable by ultimate tensile strength at 700° C. of at least 800 MPa, or at least 900 MPa, or at least 1000 MPa, or in the range of 800 to 1200 MPa or 800 to 1100 MPa (these properties refer to measurements in tension using the ASTM standard E-8); characterizable by ultimate tensile strength at 750° C. of at least 800 MPa, or at least 850 MPa, or at least 900 MPa, or in the range of 800 to 1050 MPa or 800 to 950 MPa (these properties refer to measurements in tension using the ASTM standard E-8); characterizable by ultimate tensile strength at 800° C. of at least 600 MPa, or at least 650 MPa, or at least 700 MPa, or in the range of 650 to 900 MPa or 650 to 800 MPa (these properties refer to measurements in tension using the ASTM standard E-8); characterizable by 0.2% yield stress at room temperature of at least 850 MPa, or at least 900 MPa, or at least 1000 MPa, or in the range of 800 to 1150 MPa or 800 to 1100 MPa(these properties refer to measurements in tension using the ASTM standard E-8); characterizable by 0.2% yield stress at 600° C. of at least 750 MPa, or at least 850 MPa, or at least 900 MPa, or in the range of 750 to 1050 MPa or 750 to 1000 MPa (these properties refer to measurements in tension using the ASTM standard E-8); characterizable by 0.2% yield stress at 700° C. of at least 700 MPa, or at least 800 MPa, or at least 850 MPa, or in the range of 700 to 1000 MPa or 700 to 950 MPa (these properties refer to measurements in tension using the ASTM standard E-8); characterizable by 0.2% yield stress at 750° C. of at least 700 MPa, or at least 750 MPa, or at least 800 MPa, or in the range of 700 to 850 MPa or 700 to 800 MPa (these properties refer to measurements in tension using the ASTM standard E-8); and/or characterizable by 0.2% yield stress at 800° C. of at least 500 MPa, or at least 550 MPa, or at least 600 MPa, or in the range of 500 to 800 MPa or 500 to 700 MPa (these properties refer to measurements in tension using the ASTM standard E-8).

In another aspect, the invention provides a nickel alloy comprising Cr and Nb and characterizable by one, or any combination of the properties described above. Optionally, the alloy can be further characterized as comprising one or any combination of the elemental compositions discussed above.

In another aspect, the invention provides a nickel alloy, comprising: 17 to 25% Cr; 3.0 to 5.0% Nb; 0.1 to 4.0% Ta; 4.0 to 7.0 Nb+Ta; greater than 50% Ni and characterizable by one or any combination of the following properties: a time to failure at 700° C. and 483 MPa of at least 230 h, or at least 270 h, or at least 300 h, or at least 400 h, or in the range of 230 to 750 h or in the range of 230 to 700 h (this property refers to measurements in creep using the ASTM standard E-139); and 0.2% yield stress at 750° C. of at least 700 MPa, or at least 750 MPa, or at least 800 MPa, or in the range of 700 to 850 MPa or 700 to 800 MPa (this property refers to measurements in tension using the ASTM standard E-8). The nickel alloy may also comprise δ (and/or η) phase precipitates at the grain boundaries. Preferably, the alloy further comprises γ' (or γ" or γ'/γ") precipitates distributed within a γ matrix grain interior.

In a further aspect, the invention provides a solid nickel alloy comprising Cr; Al; Ti; Nb; Ta; Mo, comprising a chemical inhomogeneity of Cr; Al; Ti; Nb; Ta; and Mo that is less than 10%; and wherein chemical inhomogeneity is characterizable by a measurement using wavelength dispersive x-ray fluorescence on a polished cross-section the alloy and wherein any selected 10 μm diameter area within a 10 $mm^2$ area of the polished surface has an elemental composition of each of Cr; Al; Ti; Nb; Ta; Mo that is within 10% of each element in the 10 $mm^2$ area. In various embodiments, the alloy may also be characterizable by a level of chemical homogeneity of less than ±1%, or less than ±2%, or less than ±5%; and/or comprising at least 15% Cr; at least 0.1% Al; at least 1.0% Ti; at least 2.0% Nb; at least 0.1% Ta; and at least 5.0% Mo; and/or wherein the nickel alloy comprises any of the compositions described above.

In some preferred embodiments of the invention, the alloy comprises at least 0.1% Ta, or at least 0.2% Ta, or at least 1.0% Ta, or 0.1 to 4.0% Ta; or none or consisting essentially of none of Co. Throughout the descriptions, "%" means weight %. Throughout the specification, properties refer to measurements in tension at 750° C. using ASTM standard E-8 and in creep at 700° C. and 70 ksi (483 MPa) and 790° C. and 30 ksi (207 MPa) using the ASTM standard E-139.

In a further aspect, the invention provides a method of homogenizing a nickel alloy comprising Cr and Nb, comprising at least two of the sequential steps of treating the nickel alloy: (1030±25° C. for 0.5 to 5 h); (1065±25° C. for 1.5 to 10 h); (1090±25° C. for 1.5 to 10 h); (1115±25° C. for 1.5 to 10 h); (1135±25° C. for 3 to 15 h); and (1150±25° C. for 30 to 150 h). The method can be further characterized by a level of chemical homogeneity, defined as variations between local and nominal chemistry following homogenizing, of less than ±1%, or less than ±2%, or less than ±5%, or less than ±10%. The chemical homogeneity properties refer to measurements using wavelength dispersive x-ray fluorescence. The method may further comprise a subsequent step of hot working at 1105±25° C. and/or further comprising an aging heat treatment comprising: (820±30° C. for 5 to 100 h) followed by cooling to (750±15° C. at a rate of 1 to 5° C./min) and then holding at (750±15° C. for 2 to 15 h). The methods may be further characterized by composition of the nickel alloy as described above.

In another aspect, the invention provides a method of heat treating a nickel alloy comprising Cr and Nb, comprising the sequential steps of treating the nickel alloy: 820±30° C. for 5 to 100 h followed by cooling to 750±15° C. at a rate of 1 to 5° C./min, and then holding at (750±15° C. for 2 to 15 h). The methods may be further characterized by composition of the nickel alloy as described above. Preferably, the treatments increase life of the alloy in creep at 700° C. and 483 MPa by at least 40%, or at least 100%, or in the range of 40 to 400%, 50 to 400% or 40 to 370%. The properties refer to measurements in creep using the ASTM standard E-139. Preferably, the treatment increases the elongation to failure of the alloy in creep at 700° C. and 483 MPa by at least 40%, or at least 100%, or in the range of 40 to 400%, 50 to 400% or 40 to 375%. The properties refer to measurements in creep using the ASTM standard E-139.

The invention also includes an alloy made by any of the methods described herein.

The invention also includes articles comprising an alloy of the type described herein. For example, a steam turbine, coal fired boiler, gas turbine, gas turbine component such as compressor blade, turbine blade, turbine disc, spacer, or turbine vane, combustion can, boiler tube, boiler pipe, header, power generation systems using fluids such as supercritical carbon dioxide (e.g. advanced ultra-supercritical power plants), concentrated solar power plants, nuclear power plants, molten salt reactors: casings, valves, heat exchangers and/or recuperators; or components thereof.

The invention may comprise any of the materials, conditions, properties, or other features mentioned herein.

Various aspects of the invention are described using the term "comprising;" however, in narrower embodiments, the invention may alternatively be described using the terms "consisting essentially of" or, more narrowly, "consisting of.

DETAILED DESCRIPTION OF THE INVENTION

Figure 1:
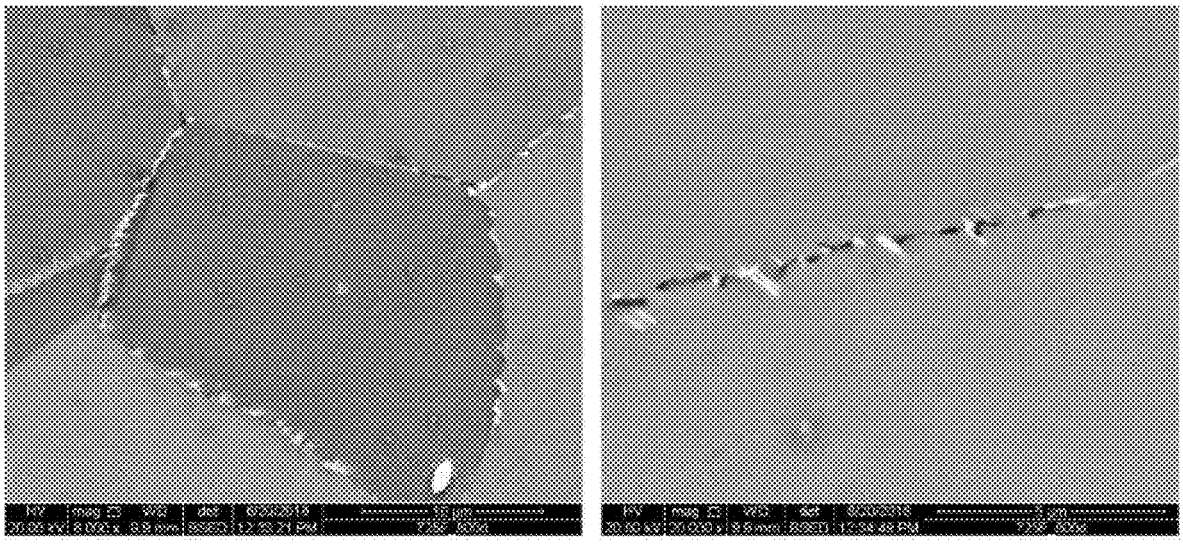
FIG. 1 shows δ phase precipitates located at the grain boundaries of alloy F.

In one aspect, the invention comprises a cast/wrought alloy of composition within the range of major elements listed in Table 2. (Note: In Table 1A and 1B, chemistry does not specify Ta additions nor does it specify a Nb+Ta guideline. Also, the balance of Fe in the NETL patent is set at between 2 and 4 wt. %, while in both patent examples Fe forms the balance, which may or may not fall within this range. Alternatively, Ni forms the balance in the NETL patent while it is fixed in each of the others. In addition, in the NETL patent a fixed level of B is specified and other minor differences in trace elements exist.)

Additionally, and more importantly, the alloy is subjected to (1) NETL calculated homogenization cycle and (2) high temperature (HT) post-thermomechanical processing (TMP) aging heat treatment that enables the intentional precipitation of secondary phases (i.e., δ and/or η) at the grain boundaries to increase their resistance to deformation and damage and/or γ' and/or γ" precipitates in the grain interior to facilitate high room and high temperature yield stress and tensile strength.

TABLE 2

Composition range for the alloy, Ni and impurities balanced (wt. %).

| Element | Cr | Al | Ti | Nb | Ta | Nb + Ta | Fe | C | Mn | Mo | W | Si | V | P | S | B | Ti/Al |
|---|---|---|---|---|---|---|---|---|---|---|---|---|---|---|---|---|---|
| Min. | 19.0 | 0.1 | 1.0 | 3.0 | 0.1 | 4.0 | 2.0 | — | — | 7.0 | — | — | — | — | — | — | 1.0 |
| Max. | 22.5 | 1.0 | 2.0 | 5.0 | 4.0 | 7.0 | 4.0 | 0.06 | 0.35 | 9.5 | 5.0 | 0.20 | 0.05 | 0.015 | 0.010 | 0.010 | 20.0 |

Several alloys were made following the details of the invention, as well as alloys outside the range of Table 2 (and closer to Tables 1A and 1B) for comparison and using melt processing techniques of an industrial nature. The compositions were designed from computational thermodynamic modeling performed using the software Thermo-Calc for phase diagrams and with the knowledge that Nb and Ta are elements that promote the formation of δ ($Ni_3Nb$), ($Ni_6AlNb$) and γ" ($Ni_3(Nb,Ta)$).

Nine ingots of approximately 6.8 kg were made at NETL, namely Alloy STD, A, B, C, D, E, F, E1 and F2, with compositions listed in Table 3. The compositions of E, F, E1 and F2 are within the range of the invention (Table 2), while Alloy STD is the closest in chemistry to standard alloy 725. Alloys A, B, C, D were designed to investigate the effect of the Ti/Al ratio on tension and creep properties. The alloy compositions were composed of high-purity industry-grade melt materials with, or without, master alloys to incorporate Cr to the melt.

TABLE 3

Composition of the various heats from XRF analysis for the main elements, combustion analysis for C and calculated from the melt addition for B (wt. %) and calculated Ti/Al ratio.

| Alloy | Cr | Al | Ti | Nb | Ta | Fe | C | Mn | Mo | Si | B | Ni | Ti/Al |
|---|---|---|---|---|---|---|---|---|---|---|---|---|---|
| STD | 21.19 | 0.24 | 1.82 | 3.44 | 0.16 | 3.87 | 0.039 | 0.04 | 7.08 | 0.018 | 0.003 | Bal. | 7.6 |
| A | 21.20 | 0.19 | 1.84 | 3.41 | 0.37 | 3.88 | 0.040 | 0.05 | 7.06 | <0.010 | 0.003 | Bal. | 9.7 |
| B | 21.22 | 0.60 | 1.41 | 3.43 | 0.36 | 3.90 | 0.039 | 0.04 | 7.09 | 0.020 | 0.003 | Bal. | 2.4 |
| C | 21.23 | 0.68 | 1.29 | 3.44 | 0.39 | 3.88 | 0.040 | 0.05 | 7.09 | 0.014 | 0.003 | Bal. | 1.9 |
| D | 21.24 | 0.85 | 1.10 | 3.42 | 0.36 | 3.92 | 0.044 | 0.06 | 7.09 | 0.033 | 0.003 | Bal. | 1.3 |
| E | 21.15 | 0.89 | 1.15 | 3.38 | 3.46 | 3.88 | 0.038 | 0.04 | 7.02 | 0.021 | 0.003 | Bal. | 1.3 |
| F | 21.29 | 0.84 | 1.13 | 4.51 | 0.37 | 3.92 | 0.040 | 0.04 | 7.09 | <0.010 | 0.003 | Bal. | 1.3 |
| E1 | 20.51 | 0.20 | 1.87 | 3.35 | 3.55 | 3.83 | 0.049 | 0.05 | 7.03 | <0.010 | 0.003 | Bal. | 9.4 |
| F2 | 20.59 | 0.19 | 1.88 | 4.55 | 0.38 | 3.86 | 0.049 | 0.05 | 7.09 | <0.010 | 0.003 | Bal. | 9.9 |

The master alloys were used in Alloy STD to F and consisted of Ni-25Cr, Fe-24Cr and/or Ni-50Cr that were melted using vacuum induction melting (VIM) followed by electroslag remelting (ESR) to lower the concentration of tramp elements. The alloys were vacuum induction melted under Ar partial pressure to about 50° C. above the liquidus temperature predicted using Thermo-Calc. The liquid was then poured in a graphite mold with ceramic wash coat to prevent C pickup and solidified as cylindrical ingots. The ingots were then homogenized using the NETL approach, which assesses the chemistry and secondary dendrite arm spacing (SDAS) in a computational manner so as to minimize heterogeneity on a nanometer scale (see Jablonski and Hawk, J Mat Eng and Perf, V26, N1 pp 4-13 (2017)). The homogenization treatment schedule used is based on the chemistry and scale of the microstructure (SDAS) which is established by the section size of the cast ingot (Table 4). This homogenization heat treatment schedule incorporates thermodynamic factors as well as kinetic ones (i.e., time for specific critical elements to diffuse within the γ matrix) to complement microstructural considerations (i.e., spacing of dendrite arms in the solidified microstructure as well as the interdendritic spacing between those arms), and the sequence described encompasses homogeneity within the alloy from at least 1% to 10% of nominal for each element calculated using computational thermodynamic tools. The stepped approach to raising temperature during homogenization is done to avoid localized melting. After a time at lower temperature the chemistry has sufficiently homogenized to allow the raise in temperature incrementally which improves the time efficiency of homogenization while avoiding localized melting.

TABLE 4

Heat treatments required to obtain a certain residual inhomogeneity.

| Section Size | Residual Inhomogeneity <10% | <5% | <1% |
|---|---|---|---|
| Up to 5 in | 1030° C./1 h + 1065° C./3 h + 1090° C./3 h + 1115° C./3 h + 1135° C./6 h + 1150° C./30 h | 1030° C./1 h + 1065° C./3 h + 1090° C./3 h + 1115° C./3 h + 1135° C./6 h + 1150° C./48 h | 1030° C./1 h + 1065° C./3 h + 1090° C./3 h + 1115° C./3 h + 1135° C./6 h + 1150° C./72 h |
| 5-8 in | 1030° C./2 h + 1065° C./6 h + 1090° C./6 h + 1115° C./8 h + 1135° C./12 h + 1150° C./50 h | 1030° C./2 h + 1065° C./6 h + 1090° C./6 h + 1115° C./8 h + 1135° C./12 h + 1150° C./100 h | 1030° C./2 h + 1065° C./6 h + 1090° C./6 h + 1115° C./8 h + 1135° C./12 h + 1150° C./200 h |
| >8 in | 1030° C./4 h + 1065° C./12 h + 1090° C./12 h + 1115° C./12 h + 1135° C./24 h + 1150° C./100 h | 1030° C./4 h + 1065° C./12 h + 1090° C./12 h + 1115° C./12 h + 1135° C./24 h + 1150° C./100 h | 1030° C./4 h + 1065° C./12 h + 1090° C./12 h + 1115° C./12 h + 1135° C./24 h + 1150° C./100 h |

The ingots were then hot worked at 1105±25° C. using steps of forging followed by hot rolling with reheating between each step to form 10 mm thick plates. The last reheat thermal cycle (following the last hot rolling step) was used as a solution heat treatment which lasted 400±100 seconds.

The TMP plates were then aged following the designed high temperature (HT) post-TMP aging heat treatment, which consisted of the following:

High temperature (HT) post-TMP aging heat treatment: (820±30° C. for 5 to 100 h) followed by cooling to (750±15° C. at 1 to 5° C./min) and then holding at (750±15° C. for 2 to 15 h).

The first thermal cycle in the heat treatment is used to allow sufficient time for the precipitation of specific grain boundary phases. The second step allows for precipitation (or additional precipitation) and growth of the γ' and/or γ" precipitates without disturbing the grain boundary phases. The cooling rate between each step was selected from a furnace programming standpoint. This cooling rate can be adjusted or simple furnace cooling can be employed. Argon gas fan cooling is used at the end of the heat treatment cycle to rapidly cool the plates to room temperature.

Mechanical testing was performed in tension between room temperature and 750° C. using the ASTM standard E-8 and in creep at 700° C./483 MPa and 790° C./207 MPa with additional conditions for some of the alloys using the ASTM standard E-139. The heat treatment conditions for the specimens tested are as follows: 1105° C. for 300 to 360 seconds for solution; 1030° C. for 1 h+1065° C. for 3 h+1090° C. for 3 h+1115° C. for 3 h+1135° C. for 6 h+1150° C. for 72 h for homogenization; and 800° C. for 20 h followed by cooling to 750° C. at 1 to 5° C./min and holding at 750° C. for 8 h.

Observation of the microstructure of the alloys reveals the formation of various precipitate phases varying as a function of the alloy composition. For example, δ (and/or η) phase precipitates along the grain boundaries following the HT aging treatment are shown in alloy F and represented in FIG. 1 (identified using energy dispersive spectroscopy). This is a desirable microstructural feature, that is, the formation of designed small precipitates (i.e., δ and/or η) along the boundaries that remain stable under loading conditions particularly at high temperatures.

Alloy STD, closest in composition to standard alloy 725, was evaluated with the standard aging heat treatment as specified by the manufacturer to compare to the mechanical properties of the invention (alloys with compositions in the range of Table 2 with the HT aging treatment). The standard aging heat treatment specified in the Special Metals datasheet for alloy 725 consists of the following:

Standard heat treatment (SHT): (732° C. for 8 h) followed by cooling to (621° C. at 56° C./h) and holding at (621° C. for 8 h)

Specimens from Alloy STD, A, B, C, D, E and F were tested after SHT while other specimens from Alloy STD, D, E, F, E1 and F2 were tested after HT aging treatment. Specimens E, F, E1 and F2 contain higher levels of Nb and Ta (within Table 2) and were optimized for the HT aging treatment.

The creep properties of the alloys are listed in Table 5 and some of the results are discussed below using figures to facilitate the observation of various trends.

Note: Alloys A, B and C will not be discussed as they were part of a previous investigation where the Ti/Al ratio was investigated. See (https://link.springer.com/chapter/10.1007%2F978-3-319-89480-5_26).

From Table 3, the alloys of invention have either a low Ti/Al ratio (E, F, based on D) or high Ti/Al (E1, F2, similar to the standard 725-like Alloy STD) which was employed to favor the precipitation of either γ' or γ" within the grains and potentially either δ or η along the grain boundaries since increasing Al promotes formation of γ' and Ti promotes formation of η. Phase stability is discussed at the end of this section.

TABLE 5

Creep properties of the various alloys

| Alloy | Aging | Temperature (° C.) | Stress (MPa) | Time to Failure (h) | LMP (C = 20)/1000 | Elongation to Failure (%) |
|---|---|---|---|---|---|---|
| STD | Standard (SHT) | 700 | 483 | 194 | 21.686 | 9.0 |
| | | 750 | 345 | 173 | 22.750 | 7.7 |
| | | 790 | 207 | 316 | 23.917 | 7.8 |

TABLE 5-continued

Creep properties of the various alloys

| Alloy | Aging | Temperature (° C.) | Stress (MPa) | Time to Failure (h) | LMP (C = 20)/1000 | Elongation to Failure (%) |
|---|---|---|---|---|---|---|
| | HT | 700 | 483 | 271 | 21.827 | 13.8 |
| | | 750 | 345 | 154 | 22.698 | 10.5 |
| | | 790 | 207 | 288 | 23.874 | 10.0 |
| A | Standard (SHT) | 700 | 483 | 217 | 21.733 | 8.9 |
| B | Standard (SHT) | 700 | 483 | 153 | 21.586 | 5.5 |
| C | Standard (SHT) | 700 | 483 | 122 | 21.490 | 4.3 |
| D | Standard (SHT) | 700 | 483 | 80 | 21.312 | 1.7 |
| | HT | 700 | 483 | 231 | 21.760 | 5.7 |
| | | 790 | 207 | 355 | 23.971 | 14.2 |
| E | Standard (SHT) | 700 | 483 | 104 | 21.423 | 0.6 |
| | HT | 700 | 483 | 490 | 22.078 | 3.9 |
| | | 790 | 207 | 462 | 24.093 | 12.3 |
| F | Standard (SHT) | 700 | 483 | 171 | 21.633 | 1.4 |
| | HT | 700 | 483 | 432 | 22.024 | 5.1 |
| | | 790 | 207 | 393 | 24.018 | 9.5 |
| E1 | HT | 700 | 483 | 690 | 22.222 | 7.1 |
| | | 725 | 414 | 457 | 22.615 | 7.6 |
| | | 750 | 345 | 414 | 23.137 | 8.0 |
| | | 790 | 207 | 548 | 24.171 | 8.6 |
| F2 | HT | 700 | 483 | 409 | 22.001 | 6.7 |
| | | 725 | 414 | 424 | 22.582 | 7.3 |
| | | 750 | 345 | 310 | 23.009 | 9.4 |
| | | 790 | 207 | 384 | 24.007 | 9.8 |

Figure 2:
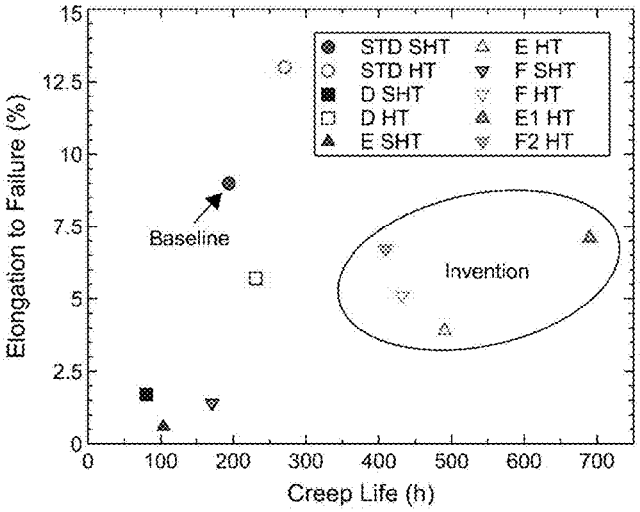
FIG. 2 shows elongation to failure as a function of creep life at 700° C. and 483 MPa for alloy STD, D, E, F with either SHT or HT aging heat treatment and alloys E1 and F2 with the HT aging heat treatment.

The creep results at 700° C. and 483 MPa are compared for all alloys that were either aged using the SHT or the HT heat treatment in FIG. 2. Note: alloys E1 and F2 were only tested in the HT condition. From FIG. 2, the HT aging treatment resulted in dramatic increases in both the creep life and creep ductility of the alloys. Using the HT aging treatment resulted in the following improvements compared to the standard aging treatment:

The life of Alloy STD increased by 40% and its ductility by 53%.

The life of alloy D increased by 189% and its ductility by 235%.

The life of alloy E increased by 371% and its ductility by 550%.

The life of alloy F increased by 153% and its ductility by 264%.

Comparing to Alloy STD in its standard aging heat treatment (SHT, or condition most representative of standard alloy 725/625 PLUS):

The HT aging heat treatment resulted in an improvement of creep life by 40% and ductility by 53%.

The HT aging treatment combined with Nb addition resulted in an improvement of creep life of >110%.

The HT aging treatment combined with Nb addition and low Ti/Al ratio resulted in an improvement of creep life of >120%.

The HT aging treatment combined with Ta addition resulted in an improvement of creep life of >250% with slightly lower ductility.

The HT aging treatment combined with Ta addition and low Ti/Al ratio resulted in an improvement of creep life of >130%.

These results underline improvements of the invention, that is, HT aging heat treatment combined with the elevated concentrations of Nb and/or Ta result is superior creep performance measured as creep life.

Note: The low Ti/Al alloys have lower ductility in general (D, E, F) compared to the high Ti/Al ratio alloys STD, E1 and F2.

Figure 3:
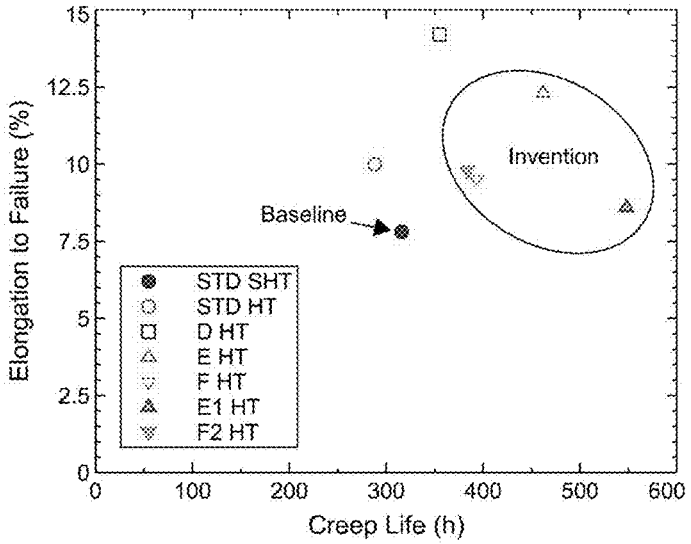
FIG. 3 shows elongation to failure as a function of creep life at 790° C. and 207 MPa for alloy STD with the SHT and HT aging heat treatment and alloys D, E, F, E1 and F2 with the HT aging heat treatment.

A second creep condition was investigated for most alloy/heat treatment conditions and consisted of 790° C. and 207 MPa. The results are represented in FIG. 3. Comparison with Alloy STD (with SHT aging) showed that chemistry variations combined with HT aging extended each alloy variant creep life. The creep life increased by 73% in alloy E1 with a slight increase in ductility of 10% while the creep life increased by 46% in alloy E with a 58% increase in creep ductility. The creep life increased by 22% in alloy F2 with a 26% increase in creep ductility while the creep life increased by 24% in alloy F with a 22% increase in creep ductility.

Figure 4:
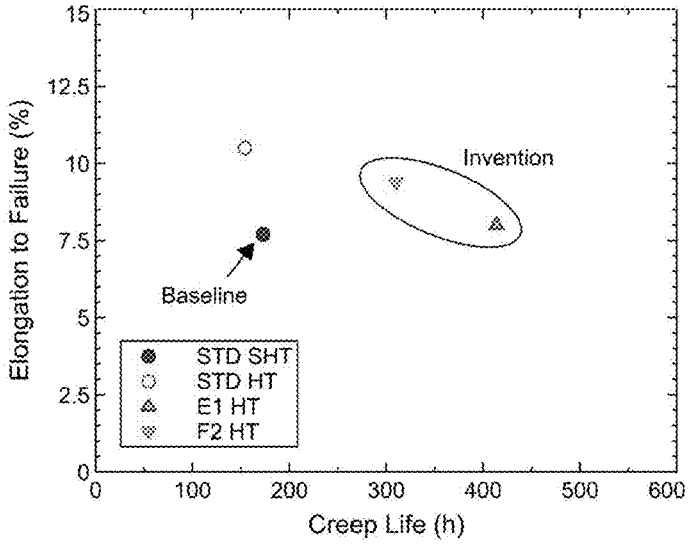
FIG. 4 shows elongation to failure as a function of creep life at 750° C. and 345 MPa for alloy STD with the SHT and HT aging heat treatment and alloys E1 and F2 with the HT aging heat treatment.

Another creep condition was considered for alloys E1 and F2 following the HT aging heat treatment with comparison to alloy STD and consisted of 750° C. and 345 MPa. The results are represented in FIG. 4. Comparison with Alloy STD (with SHT aging) showed that chemistry variations combined with HT aging extended each alloy variant creep life. The creep life increased by 139% in alloy E1 with a 4% increase in creep ductility while the creep life increased by 79% in alloy F2 with a 22% increase in creep ductility.

Results from tension testing are compiled in Table 6. Similar to the description of the creep results, figures are provided below to better illustrate the trends.

TABLE 6

Tensile properties of the various alloys

| Alloy | Aging | Temperature (° C.) | UTS (MPa) | 0.2% Yield Stress (MPa) | Elongation to failure (%) |
|---|---|---|---|---|---|
| STD | Standard (SHT) | 24 | 1,224 | 809 | 43.1 |
| | | 200 | 1,135 | 752 | 40.7 |
| | | 400 | 1,053 | 730 | 43.9 |
| | | 500 | 1,022 | 723 | 40.5 |
| | | 600 | 978 | 734 | 37.5 |
| | | 650 | 1,074 | 748 | 24.6 |
| | | 700 | 882 | 650 | 24.7 |
| | | 750 | 794 | 622 | 16.5 |

TABLE 6-continued

Tensile properties of the various alloys

| Alloy | Aging | Temperature (° C.) | UTS (MPa) | 0.2% Yield Stress (MPa) | Elongation to failure (%) |
|---|---|---|---|---|---|
| | HT | 24 | 1,246 | 812 | 32.3 |
| | | 750 | 790 | 664 | 38.3 |
| A | Standard (SHT) | 24 | 1,282 | 861 | 39.6 |
| | | 750 | 806 | 646 | 8.0 |
| B | Standard (SHT) | 24 | 1,150 | 722 | 48.0 |
| | | 750 | 710 | 538 | 14.0 |
| C | Standard (SHT) | 24 | 1,149 | 724 | 47.4 |
| | | 750 | 705 | 535 | 14.4 |
| D | Standard (SHT) | 24 | 1,186 | 749 | 43.0 |
| | | 200 | 1,092 | 685 | 46.5 |
| | | 400 | 1,007 | 671 | 44.4 |
| | | 500 | 988 | 670 | 44.5 |
| | | 600 | 966 | 659 | 39.9 |
| | | 650 | 930 | 644 | 18.3 |
| | | 700 | 800 | 606 | 12.5 |
| | | 750 | 698 | 566 | 8.3 |
| | HT | 24 | 1,222 | 722 | 35.4 |
| | | 750 | 822 | 629 | 20.2 |
| E | Standard (SHT) | 24 | 1,224 | 838 | 42.9 |
| | | 750 | 741 | 646 | 7.1 |
| | HT | 24 | 1,169 | 898 | 4.5 |
| | | 750 | 943 | 774 | 9.5 |
| F | Standard (SHT) | 24 | 1,190 | 795 | 47.8 |
| | | 750 | 706 | 595 | 7.8 |
| | HT | 24 | 1,253 | 865 | 15.5 |
| | | 750 | 899 | 735 | 10.5 |
| E1 | HT | 24 | 1,412 | 1,073 | 23.7 |
| | | 600 | 1,305 | 976 | 28.2 |
| | | 700 | 1,074 | 916 | 18.3 |
| | | 750 | 883 | 788 | 15.2 |
| | | 800 | 728 | 626 | 19.1 |
| F2 | HT | 24 | 1,384 | 1,027 | 32.1 |
| | | 600 | 1,278 | 947 | 32.9 |
| | | 700 | 1,025 | 862 | 24.9 |
| | | 750 | 845 | 740 | 17.1 |
| | | 800 | 684 | 587 | 22.0 |

Figure 5:
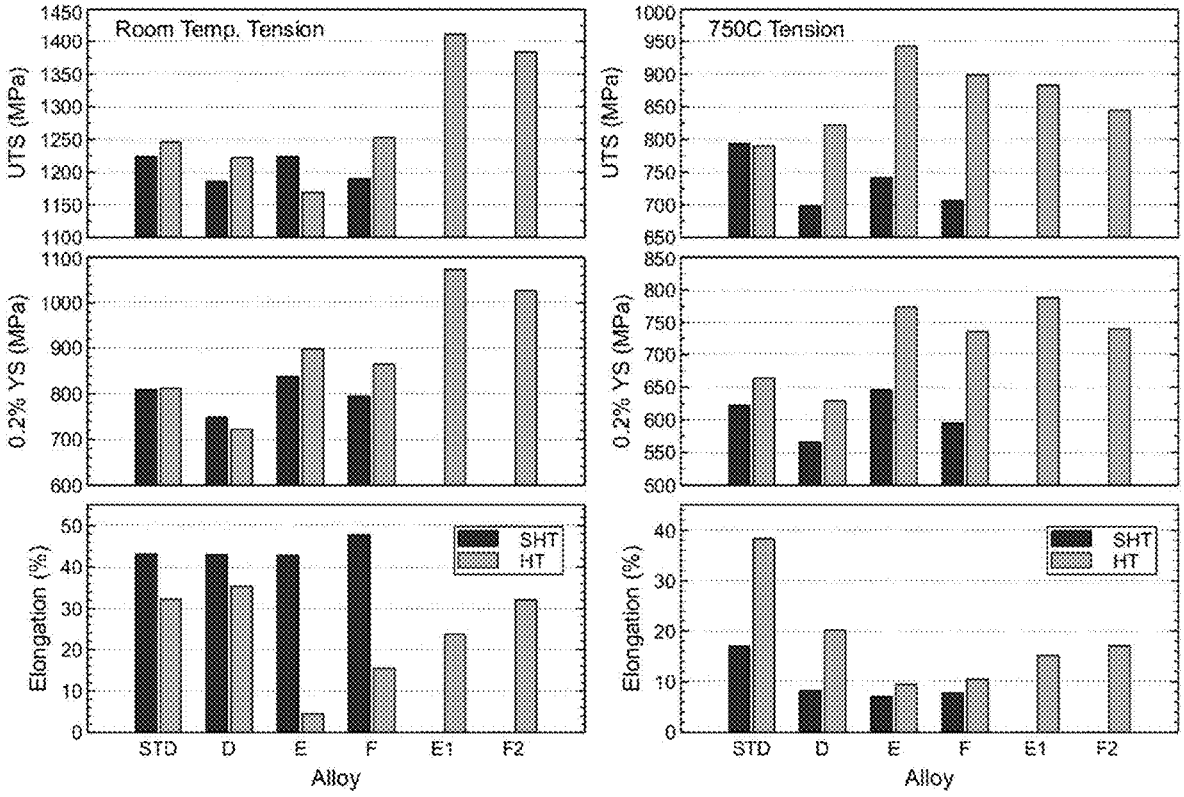
FIG. 5 shows tensile properties (UTS, 0.2% yield stress and elongation to failure) for Alloy STD, D, E, F, E1 and F2 with either standard (SHT) or HT aging heat treatment tested at room temperature (left) and 750° C. (right).

Comparison of the results from tension testing of Alloy STD, D, E, F, E1 and F2 are shown in FIG. 5 for specimens that received either the SHT or the HT aging heat treatment. Note: alloys E1 and F2 were only tested in the HT condition. Results from tests at room temperature show general improvements in ultimate tensile strength (UTS) and 0.2% yield stress (YS) for the specimens aged using the HT aging treatment minus a couple exceptions. The ductility was generally lower but satisfactory as the test condition is in excess of the targeted applications. Particularly, alloys E1 and F2 generally outperformed all others. Compared to Alloy STD with the standard aging heat treatment (SHT), the UTS was increased by 15% and the 0.2% YS by 33% in E1 with HT aging while keeping an elongation to failure above 20%.

At 750° C., results are consistently in favor of the HT aging heat treatment. The results reveal increases in UTS, YS and elongation to failure due to the HT aging heat treatment, particularly, for alloys E, F, E1 and F2 that were optimized by adding Nb and/or Ta. Compared to Alloy STD with the SHT aging treatment (i.e., the condition closest to standard INCONEL 725), the HT aging treatment and modified chemistry resulted in average increases of 12% in UTS and 22% in YS.

Figure 6:
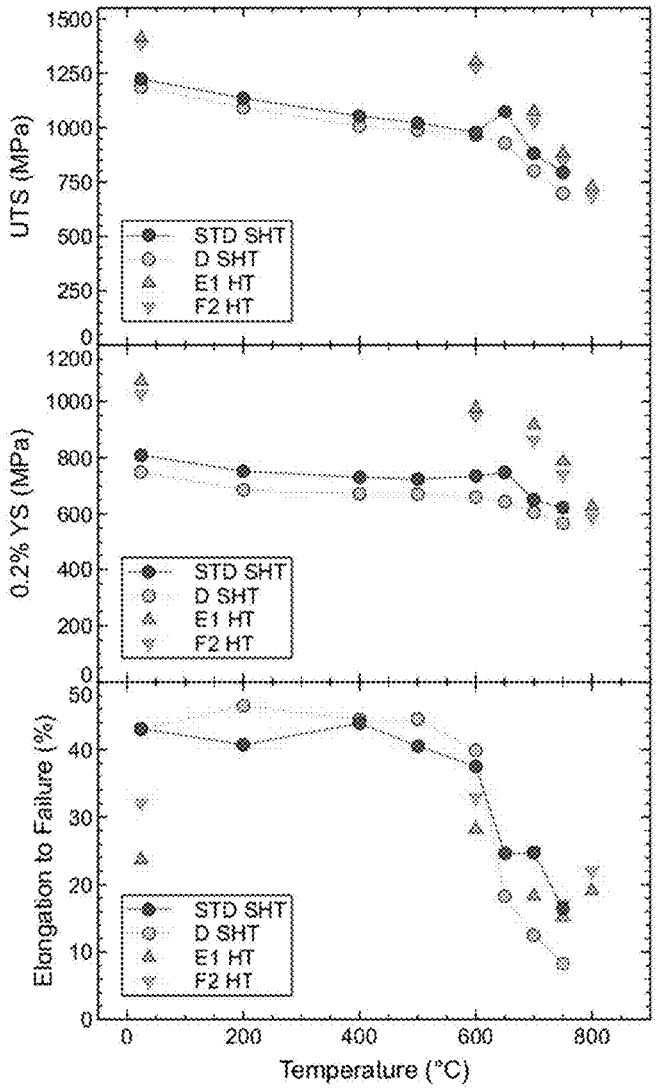
FIG. 6 shows tensile properties (UTS, 0.2% yield stress and elongation to failure) for Alloys STD and D with standard (SHT) aging heat treatment and Alloys E1 and F2 with HT aging tested over a range of temperatures from RT to 800° C.

Comparison over the range of tension testing temperatures is provided in FIG. 6 for alloys STD and D with the SHT aging and alloys E1 and F2 with the HT aging. Specifically, the UTS and 0.2% YS increased by 22% and 41% in alloy E1 and 16% and 33% in alloy F2 compared to the standard alloy.

Figure 7:
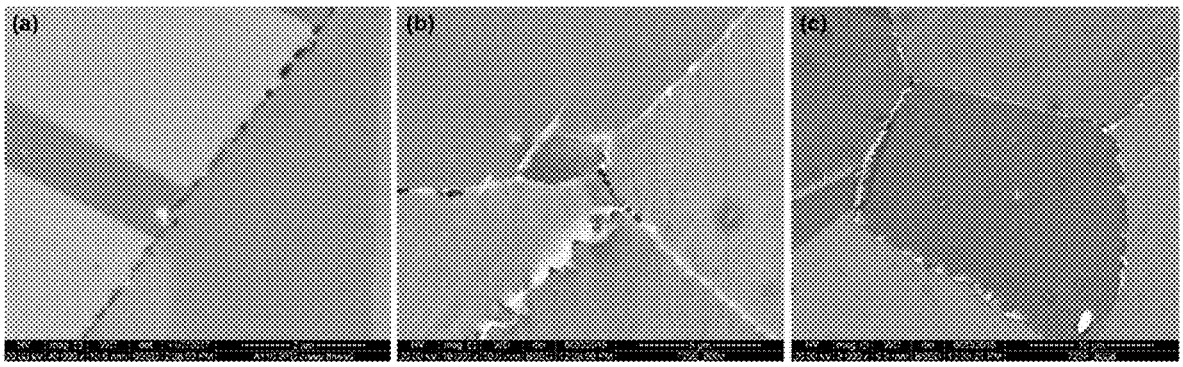
FIG. 7 shows microstructure of (a) Alloy STD after the SHT, (b) alloy E after the first step of the HT aging treatment and (c) alloy F after the first step of the HT aging treatment.

As previously mentioned, the invention may use a designed HT aging treatment, preferably combined with chemistry adjustments and a homogenization heat treatment schedule to a 1% of nominal in order to promote the formation of precipitate phases (i.e., δ and/or η) uniformly along the grain boundaries and/or complex matrix precipitate (γ' or γ" or γ'/γ") formation uniformly within the grains. In Alloy STD after the SHT aging treatment (FIG. 7*a*), the microstructure consists of grain boundary carbides (gray and white) and very fine γ' precipitates. These precipitates are also distributed within the γ matrix grain interior. However, using the high temperature first step (here 800° C. for 20 h) in the HT aging treatment promotes the formation of precipitates such as δ and/or η along the grain boundaries when high levels of Nb or Ta are used in the alloy, as observed in alloy E and F in FIGS. 7*b* and 7*c*. The δ and/or η phases reinforce the grain boundaries by adding resistance to operative deformation mechanisms. Their presence has also been reported to diminish, or arrest, crack propagation.

Figure 8:
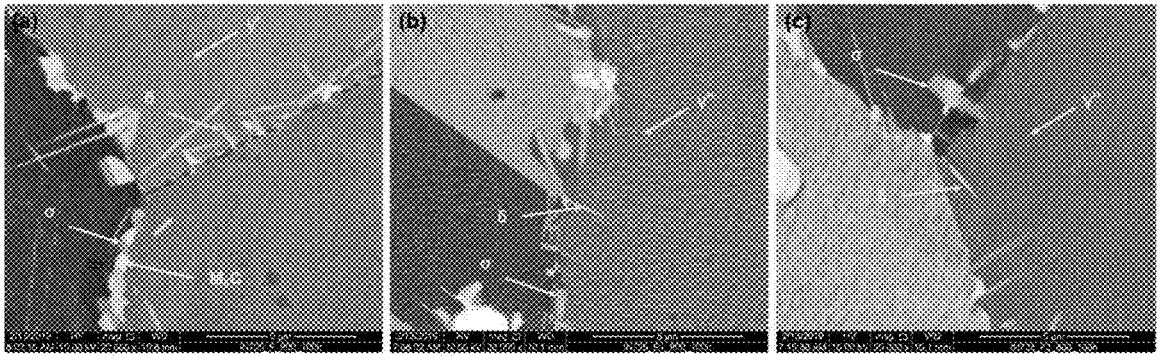
FIG. 8 shows microstructure of (a) alloy F (b) E1 and (c) F2 after □ 100 h at 800° C. Note: the phases labelled were tentatively identified using energy dispersive spectroscopy and identification was not confirmed using more advanced techniques.

Furthermore, the first step of the HT aging treatment can be adjusted, either by extending the time at the aging temperature or modifying the aging treatment temperature and holding time. For example, the time at 800° C. was changed to 100 h for alloys F, E1 and F2 to observe its microstructure. In doing so, the precipitation of δ phase (tentatively identified using energy dispersive spectroscopy) was further promoted, see for example, FIG. 8*a*.

Finally, adjustments to the Ti/Al ratio can be used to control the type of matrix precipitate (γ' or γ" or γ'/γ") strengthening desired. For instance, F (low Ti/Al ratio) contained γ' precipitates within the matrix grains that greatly contribute to its strength while E1 and F2 showed γ" matrix precipitates as observed in FIG. 8*b* and *c*.

Figure 9:
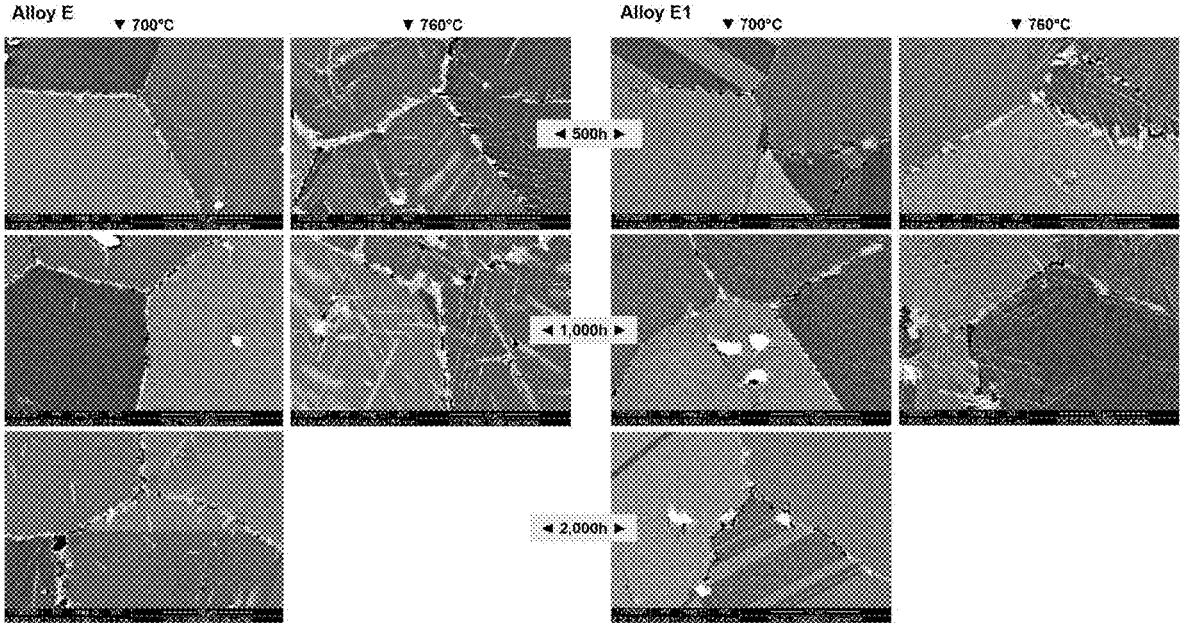
FIG. 9 shows results from a phase stability study showing alloys E and E1 exposed to 700° C. and 760° C. for 500 h, 1000 h and 2000 h.
Figure 10:
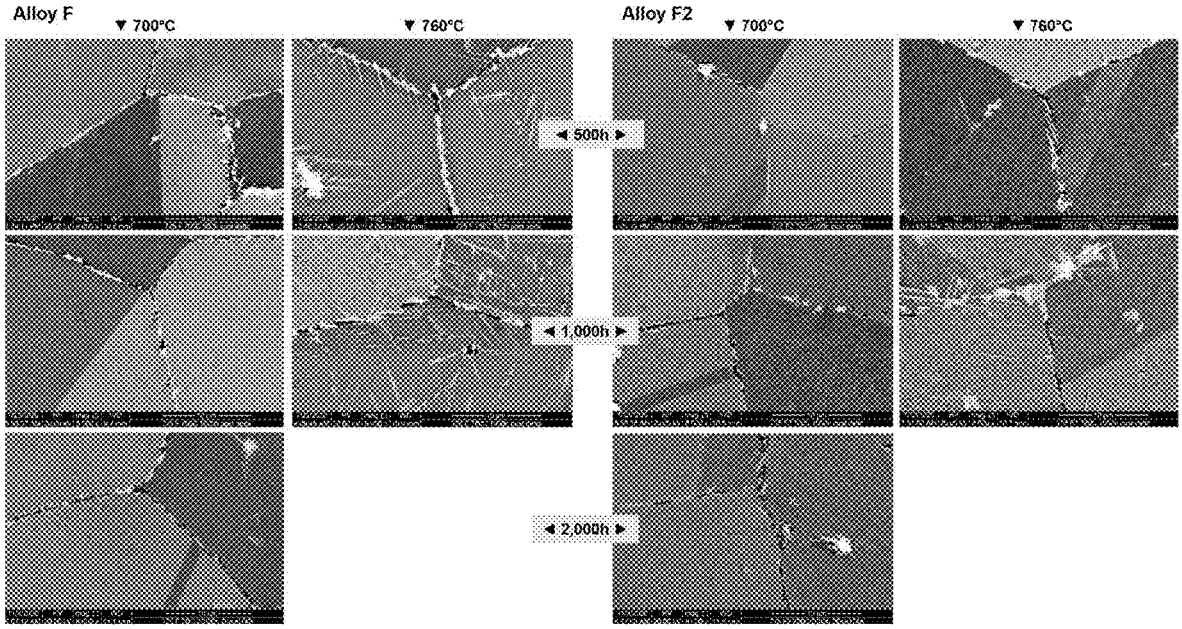
FIG. 10 shows results from a phase stability study showing alloys F and F2 exposed to 700° C. and 760° C. for 500 h, 1000 h and 2000 h.

An important consideration associated with the use of various precipitate phases along the grain boundaries to improve mechanical properties is related to phase stability. It is preferable for the precipitates to remain stable, i.e., to show limited coarsening or morphology or composition changes with increasing exposure time or temperature. Phase stability can be controlled from a combination of chemistry changes within the range of Table 2 and/or different temperature or time for the first step of the HT aging heat treatment (within the specified range). Results from a phase stability study on alloys E and E1 are shown in FIG. 9 and alloys F and F2 in FIG. 10 for exposure at 700° C. and 760° C. for 500 h, 1000 h and 2000 h. Alloys E1, F and F2 appeared more stable than E as less growth of the grain boundary phases towards the matrix was shown with increasing exposure time at 700° C. The results also revealed that the alloys are unstable at 760° C., thus this temperature is unsuitable for use of the alloys for extended times.

Figure 11:
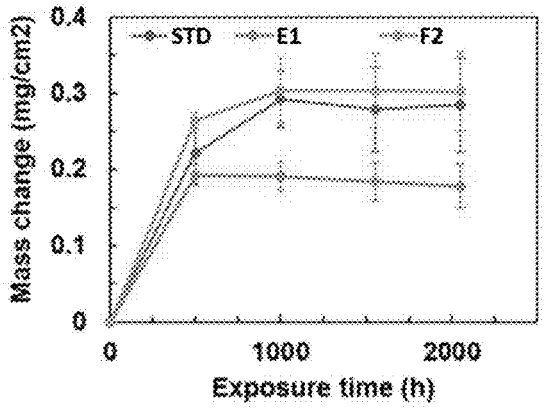
FIG. 11 shows oxidation testing results at 700° C. in air for Alloys STD, E1 and F2.

Oxidation testing was performed on alloys STD, E1 and F2 to assess if the changes in chemistry of the invention to improve high temperature mechanical properties had an effect on the oxidation resistance of the alloy. Results for testing in air at 700° C. are shown in FIG. 11 in the form of specific mass change as a function of exposure time at temperature. Alloy F2 behaved in a similar manner than the standard alloy (STD) while E1 showed lower mass gains overall. Therefore, the compositional changes did not have a negative effect on the oxidation resistance of the alloy under the testing conditions investigated.

Key Takeaways:

A) The invention provides (1) high-temperature (HT) aging heat treatment, (2) homogenization heat treatment and (3) preferred material's chemistry range (Table 2), the entirety of which produces (4) designed specific microstructures consisting of desirable precipitates along the grain boundaries between matrix grains with either γ' or γ" or γ'/γ" strengthening precipitates in the matrix grains, to enable corrosion resistant Ni-based superalloy in applications that require superior tension properties and creep resistance at temperatures above 650° C.

B) The homogenization heat treatment provides an initial uniform chemistry throughout.

C) The HT aging heat treatment employs a high temperature, long term, first step thermal exposure that enables the precipitation of secondary phases, such as (but not limited to) δ and/or η, along the grain boundaries, which serves to restrict grain boundary sliding and enhance creep performance.

D) The HT heat treatment also allows for a complex precipitation of strengthening phases (γ' or γ" or γ'/γ") within the grains interior that can be combined with the grain boundary precipitates.

E) The chemistry of the alloys can be adjusted within the range of Table 2 to favor the precipitation of γ' or γ" or γ'/γ", particularly using variations in the Al, Ti, Nb and Ta concentrations.

F) In particular, elevated levels of Nb and/or Ta favor the precipitation of δ precipitates along the grain boundaries.

Variations within the scope of the invention include but are not limited to:

Changes in composition: The composition of the alloy can be varied within the range specified in Table 2. A minimum Nb+Ta concentration was set for the formation of necessary grain boundary phases to obtain the improved properties. Ti and Al concentrations encompass Ti/Al ratios that can be tailored to form desired precipitate phases within the grains.

Homogenization heat treatment: The homogenization heat treatment used in the making the invention alloy was optimized using computational design. However, other combinations of time/temperature and number of segments can be utilized, resulting in different levels of homogenization (i.e., ±10, 5 or 1% or better). The homogenization heat treatment was specified in Table 4.

Solution heat treatment: The solution heat treatment used was 1105° C. for 5-7 min. However, this temperature can be adjusted (lower or higher) as well as the holding time to dissolve all secondary phases that may have formed during processing. Thus, the solution heat treatment was expressed as follow: 1105±25° C. for 400±100 sec.

Aging heat treatment: Aging trials revealed significant variations in the size or fraction of precipitate phases such as γ' or γ" or γ'/γ" and carbides and more importantly, the grain boundary phases. The two-step aging can be designed using different temperatures with various holding times, heating and cooling rates. The first step is needed to promote the formation of grain boundary phases, such as δ and/or η, while the second step allows for additional precipitation and growth of the γ' or γ" or γ'/γ" precipitates. The HT aging treatment is summarized below: (820±30° C. for 5 to 100 h) followed by cooling to (750±15° C. at 1 to 5° C./min) and then holding at (750±15° C. for 2 to 15 h).

The invention comprises heat resistant structural materials for applications requiring high yield stress at room temperature and good creep strength at high temperatures such as articles found in gas turbines, steam turbines, fossil energy boilers, etc., including compressor blades, turbine blades, turbine discs and spacers, turbine vanes, combustion cans, etc. The invention also comprises structural materials for components in aero engines (gas fan turbines) or power generation systems using fluids such as supercritical carbon dioxide (e.g., advanced ultra-supercritical power plants), concentrated solar power plants, nuclear power plants, molten salt reactors: turbine blades, casings, valves, heat exchangers and recuperators, etc. The invention further includes any of the articles mentioned above comprising any of the materials described herein.

The invention may comprise any of the materials, conditions, properties, or other features mentioned above. Throughout the descriptions, "%" means weight %.

What is claimed:

1. A method of homogenizing a nickel alloy comprising Cr and Nb, comprising at least two of the sequential steps of treating the nickel alloy:

1030±25° C. for 0.5 to 5 h;
1065±25° C. for 1.5 to 10 h;
1090±25° C. for 1.5 to 10 h;
1115±25° C. for 1.5 to 10 h;
1135±25° C. for 3 to 15 h; and
1150±25° C. for 30 to 150 h;

wherein the nickel alloy is characterizable by a level of chemical homogeneity, defined as variations between local and nominal chemistry following homogenizing, of less than ±10%; and an aging heat treatment comprising: 820±30° C. for 5 to 100 h followed by cooling to 750±15° C. at a rate of 1 to 5° C./min and then holding at 750±15° C. for 2 to 15 h.

2. The method of claim 1 wherein the aging heat treatment increases life of the alloy in creep at 700° C. and 483 MPa by at least 100%.

3. The method of claim 1 wherein the aging treatment increases creep ductility at 700° C. and 483 MPa by 100 to 600%.

4. The method of claim 1 wherein the cooling is done by simple furnace cooling.

5. The method of claim 1 wherein the cooling is done by argon gas fan cooling for rapid cooling.

6. The method of claim 1 wherein ultimate tensile strength, at room temperature, increased by at least 10% while keeping an elongation to failure above 20%.

7. The method of claim 1 further comprising a subsequent step of hot working at 1105±25° C.

8. A method of homogenizing a nickel alloy comprising Cr and Nb, comprising at least two of the sequential steps of treating the nickel alloy:

1030=25° C. for 0.5 to 5 h;
1065±25° C. for 1.5 to 10 h;
1090±25° C. for 1.5 to 10 h;
1115±25° C. for 1.5 to 10 h;
1135±25° C. for 3 to 15 h; and
1150±25° C. for 30 to 150 h;

wherein the nickel alloy is characterizable by a level of chemical homogeneity, defined as variations between local and nominal chemistry following homogenizing, of less than ±10%; and wherein the nickel alloy comprises 19.0 to 22.5% Cr; 0.1 to 1.0% Al; 1.0 to 2.0% Ti; 3.0 to 5.0% Nb; 0.1 to 4.0% Ta; 4.0 to 7.0% Nb+Ta; 2.0 to 4.0% Fe; 0 to 0.06% C; 0 to 0.35% Mn; 7.0 to 9.5% Mo; 0 to 5.0% W; 0 to 0.20% Si; 0 to 0.05% V; 0 to 0.15% P; 0 to 0.010% S; and 0 to 0.010% B, wherein all % are wt %, and comprising δ (and/or η) phase precipitates at the grain boundaries.

9. The method of claim 8 further comprising a subsequent step of hot working at 1105±25° C.

10. The method of claim 8 wherein 0.2% yield strength, at room temperature, increased by at least 25% while keeping an elongation to failure above 20%.

11. A method of heat treating a nickel alloy comprising Cr and Nb, comprising the sequential steps of treating the nickel alloy:

820±30° C. for 5 to 100 h, followed by cooling to 750±15° C. at a rate of 1 to 5° C./min, and then holding at 750±15° C. for 2 to 15 h; and wherein the nickel alloy comprises 17 to 25% Cr; 0.1 to 1.0% Al; 1.0 to 2.0% Ti; 3.0 to 5.0% Nb; 0.1 to 4.0% Ta; 4.0 to 7.0% Nb+Ta; and 2.0 to 4.0% Fe; greater than 50% Ni, wherein all % are wt %.

12. The method of claim 11 wherein the nickel alloy comprises 19.0 to 22.5% Cr; 0 to 0.06% C; 0 to 0.35% Mn; 7.0 to 9.5% Mo; 0 to 5.0% W; 0 to 0.20% Si; 0 to 0.05% V; 0 to 0.15% P; 0 to 0.010% S; and 0 to 0.010% B, wherein all % are wt %, and comprising δ (and/or η) phase precipitates at the grain boundaries.

13. The method of claim 12 wherein the treatments increase the elongation to failure of the alloy in creep at 700° C. and 483 MPa by 40 to 375%.

14. The method of claim 11 wherein the treatments increase life of the alloy in creep at 700° C. and 483 MPa by at least 40%.

15. The method of claim 11 wherein the treatments increase the elongation to failure of the alloy in creep at 700° C. and 483 MPa by at least 40%.

16. The method of claim 11 wherein the treatments increase life of the alloy in creep at 700° C. and 483 MPa by 40 to 370%.

17. The method of claim 11 wherein the cooling is done by simple furnace cooling.

18. The method of claim 11 wherein the cooling is done by argon gas fan cooling for rapid cooling.

* * * * *